US005891355A

United States Patent [19]

Wei et al.

[11] Patent Number: 5,891,355

[45] Date of Patent: Apr. 6, 1999

[54] SELF-SEALING, BOTTOM POURING SYSTEM

[76] Inventors: Long Wei, 7F-1, No. 19, Jan-Chien Street, Kaohsing Hsien; Su-Hui Chang, No. 24-3, Lane 32, Chien-Chung Street, Taipei Hsien, both of Taiwan

[21] Appl. No.: 870,774

[22] Filed: May 16, 1997

[30] Foreign Application Priority Data

May 23, 1996 [TW] Taiwan ..... 85106140

[51] Int. Cl.[6] ..... B22D 35/06

[52] U.S. Cl. ..... 222/593; 222/601

[58] Field of Search ..... 222/590, 591, 222/593, 601

[56] References Cited

U.S. PATENT DOCUMENTS 3,435,992 4/1969 Tisdale et al. ..... 222/593
4,461,336 7/1984 Remeika ..... 222/601

FOREIGN PATENT DOCUMENTS 2057103 3/1981 United Kingdom ..... 222/593

*Primary Examiner*—Scott Kastler
*Attorney, Agent, or Firm*—Merchant, Gould, Smith, Edell, Welter & Schmidt

[57] ABSTRACT

A pouring system comprises a crucible having an opening formed on a bottom thereof, and a self-sealing member blocking the opening. The self-sealing member is made of material which is the same as the raw material received within the bottom of the crucible. The crucible is supported on an inner distributor supported on a driving rod. The self-sealing member, inner distributor, driving rod are substantially located in a mold heating zone above which a smelting zone is disposed. When the raw material in the crucible is heated in the smelting zone by a first heat source to melt, the driving rod pushes the bottom of the crucible upward into the smelting zone. The self-sealing member is thus molten in the bottom of the crucible, un-blocking the opening to allow the melt to flow therethrough. The melt then flows through an inner distributor and flow pipes into a turnport and reaches a level condition after about 10 seconds. The driving rod is then lowered down to open pouring holes formed on the bottom of the turnport to allow the melt to flow therethrough into molds located directly under the pouring holes.

11 Claims, 5 Drawing Sheets

SELF-SEALING, BOTTOM POURING SYSTEM

FIELD OF THE INVENTION

The present invention generally relates to a pouring system and in particular to a self-sealing bottom pouring system which makes use of an opening formed on the bottom of the crucible and a self-sealing member initially blocking the opening to perform the pouring operation.

RELATED ART OF THE INVENTION

The conventional dumping type pouring method generally heats the material inside a crucible for such material to melt into a liquid form and to be poured out of the crucible manually or mechanically. This conventional technique consumes considerable labor and fails to obtain excellent quality castings. Further, it is easy to hurt operators by using such a technique.

Another conventional method is to use a cooling plate made of non-oxygenated copper or other alloys having high melting point. However, the cooling plate needs a considerably large working and rotating space and also requires a cooling cyclic system for serving as cooling medium. Malfunctioning of the cooling cyclic system or the thin wall of the cooling plate may cause melting or damage of the cooling plate, which will result in leakage of the cooling medium and in turn cause a sudden expansion. Consequently, the cracking or explosion due to the expansion will hurt the operator. In addition, when the melted metal comes in contact with the cooling plate, a portion of the cooling plate will more or less fuse or diffuse into the melt, which will cause contamination of the melt and thus introduce impurities into the final castings. Thus, such a conventional system may cause contamination of the melted metal and significantly affect the quality of the castings.

SUMMARY OF THE INVENTION

An object of the present invention is to provide a bottom pouring system wherein the melt contained in a crucible is arranged to flow out of the crucible through a bottom opening so as to overcome the shortfalls of the conventional pouring system.

Another object of the invention is to provide a bottom pouring system wherein the crucible has a unique design on the bottom to provide a more pure melt and to preserve a portion of the melt inside the crucible for pre-heating and thereby improving the melting speed of the next batch raw material.

A further object of the invention is to provide a bottom pouring system having a unique turnport incorporated in the bottom pouring system of the present invention, thereby providing uniform melt and regulating the amount of melt for pouring.

A still further object of the invention is to reduce labor and operation space, enhance the casting quality and also improve the safety of the working environment. Further, when operated in a vacuum environment, the present invention is capable of providing castings having higher precision.

The advantages and functions of the present invention will be better understood based on the following detailed descriptions and the accompanying drawings, in which:

DESCRIPTION OF THE PREFERRED EMBODIMENT

Figure 1:
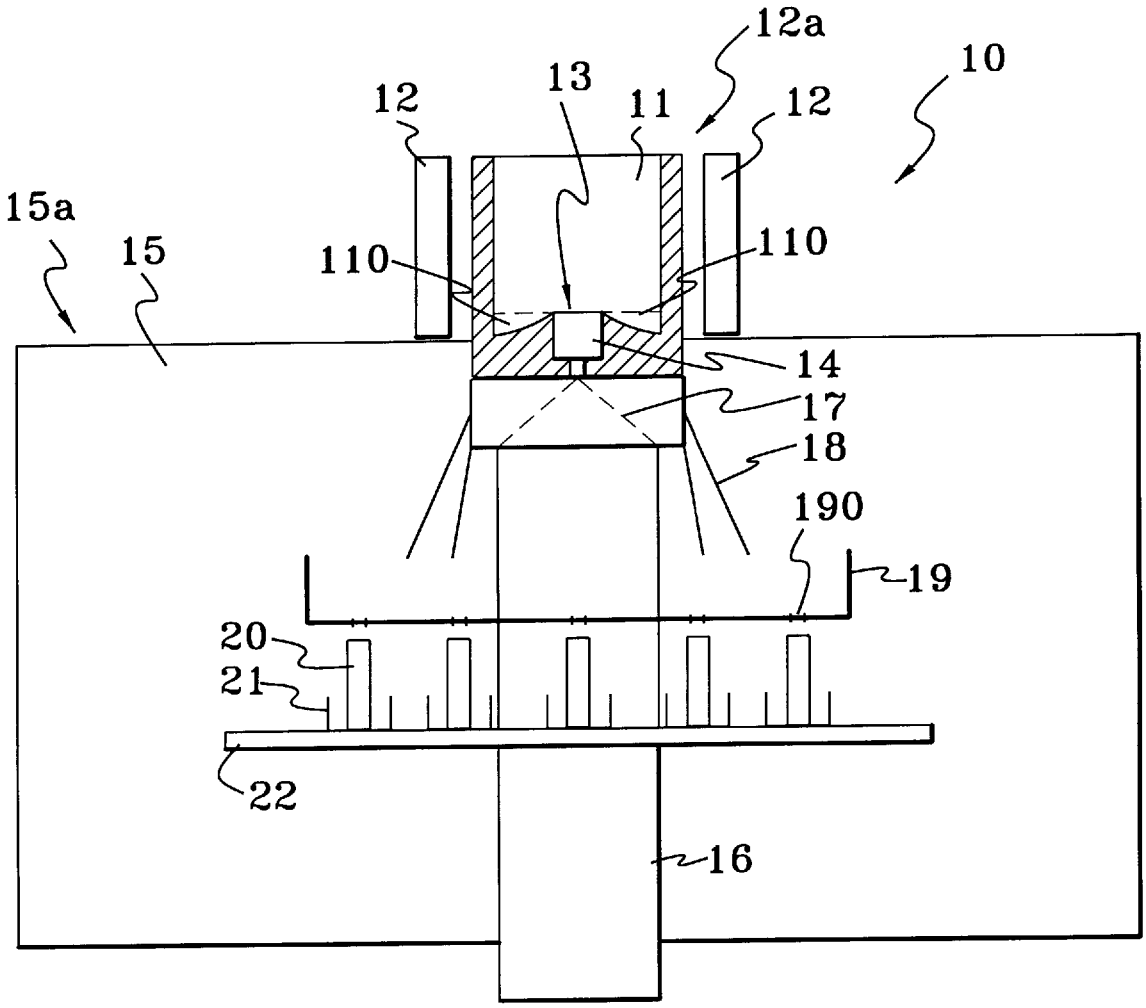
FIG. 1 is a schematic view showing the self-sealing bottom pouring system in accordance with the present invention, in which the self-sealing member is in original position.
Figure 2B:
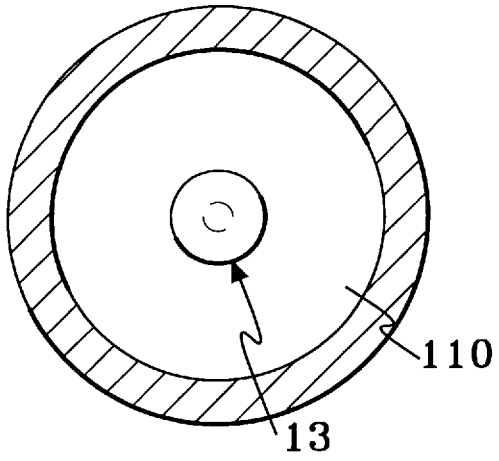
FIG. 2B is a top plan view of FIG. 2A.
Figure 2A:
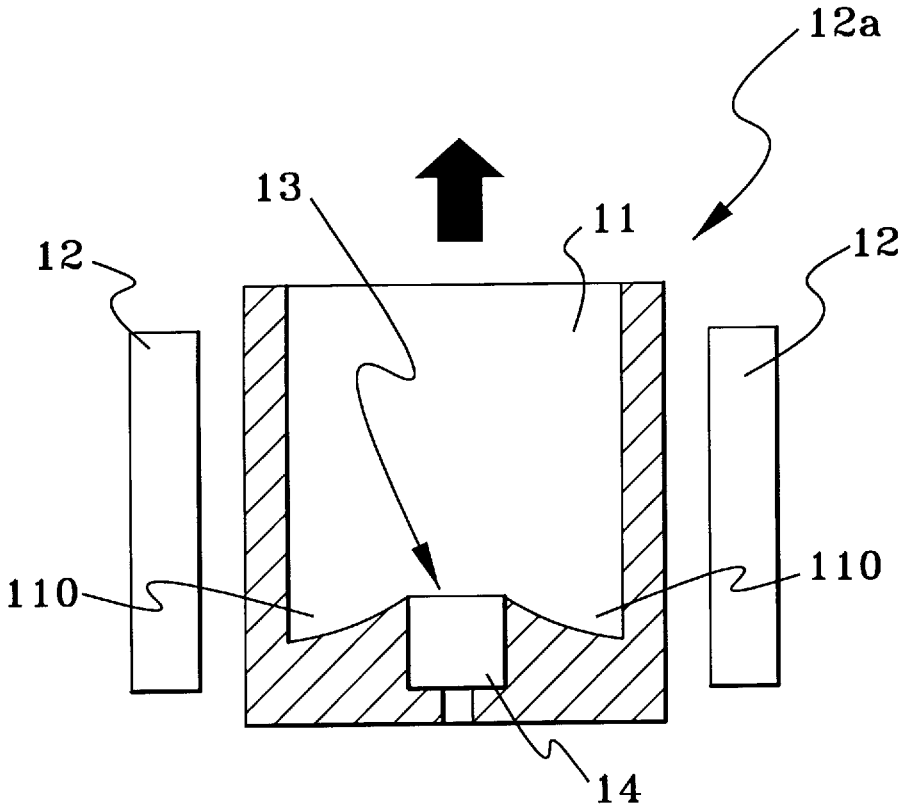
FIG. 2A is an enlarged cross-sectional view of the crucible of the system of FIG. 1, in which the bottom thereof receiving the self-sealing member has been pushed upward into the smelting zone.

FIG. 1 is a schematic view showing a self-sealing bottom pouring system 10 in accordance with the present invention. In the system 10, a crucible 11 is provided for containing raw pouring material, such as metal, glass or plastic chips and/or metal, glass or plastic ingots. The crucible 11 is made of a high temperature resistant material, such as ceramic materials. The raw material which is contained in the crucible 11 is first heated in a smelting zone 12*a* defined by a first heating source 12 to melt for subsequent pouring and casting purposes. The temperature provided by the smelting zone 12*a* varies in accordance with different raw materials utilized. For example, when the raw material to be molten is steel, the temperature thereof is approximately 1,560° C.; when the raw material is copper, the temperature thereof is approximately 1,083° C.; and when the raw material is an aluminum alloy, the temperature is about 800° C. The crucible 11 has a pouring opening 13 formed on the bottom thereof. In the present embodiment illustrated, referring to FIGS. 2A and 2B, the crucible 11 comprises a raised portion having the shape of a truncated cone which is centrally located on the bottom thereof. The bottom pouring opening 13 is formed on the raised conic portion. The remaining portion 110 which is recessed with respect to the raised conic portion serves to keep or preserve a portion of the molten material or melt therein. It should be noted that in the crucible 11, slag of the molten material floats on the surface and a major portion of the slag may be removed by means of a regular slag removing process with only a minor portion of the slag left in the crucible 11 which, along with the newly generated oxides and tiny suspended slag after the slag removing process, is expelled to circumferential edge of the crucible 11 by means of the convection of the melt due to the unique bottom configuration of the crucible 11, so that only very pure melt of the casting material is allowed to flow out of the bottom pouring opening 13. The residual melt that is preserved in the recessed portion 110 of the bottom of the crucible 11 provides a pre-heating source for the next batch of raw material to speed up the melting of the next batch of raw material.

The bottom pouring opening 13 of the crucible 11 may comprise a self-sealing member 14 fit thereto. The self-sealing member 14 is preferably made of a material which is the same as that to be molten and can be fit into the bottom pouring opening 13 in such a manner with a tolerance or gap therebetween for accommodating thermal expansion. Thus, in case a small amount of the raw material melt or part of the upper portion of the self-sealing member 14 which is molten in the smelting zone 12*a* will leak through the gap between the self-sealing member 14 and the bottom pouring opening 13, the small amount of melt becomes solidified to block the gap as it moves away from the smelting zone 12 which has a higher temperature. In the embodiment illustrated, the self-sealing member 14 has a size of, for example, 10 cm in diameter and 10 cm in height, both the height and diameter should be designed to have a tolerance for thermal expansion to avoid breakage or cracking of the bottom pouring opening 13 which receives the self-sealing member 14 in the bottom thereof.

It should be noted that the upper portion (about ⅓ to ½ in height) of the self-sealing member 14 that is located in the bottom pouring opening 13, and the bottom recessed portion 110 of the crucible 11 are both substantially located within the smelting zone 12*a*. A second heating source 15 defining a mold heating zone 15*a* which is a closed heating furnace as illustrated in the embodiment, is arranged directly below the smelting zone 12*a*. The mold heating zone 15*a* provides a temperature lower than that provided by the smelting zone 12*a* which is defined by the first heating source 12. In respect of steel material, the temperature of the second heating source 15 is about 1,100° C. or lower. Such a lower temperature keeps the self-sealing member 14 from being molten too quickly due to the high temperature of the first heating source 12. In respect of glass or plastic materials, the temperature of the second heating source may be as low as 0° C. or even lower. When the raw material contained in the crucible 11 undergoes slag formation, slag removal, degassing and refining process, and is finally heated to the fully molten condition, the self-sealing member 14, together with the crucible 11, is forced into the smelting zone 12*a* by a driving rod 16, such as a hydraulic or pneumatic driving rod, and is thus heated and molten by the first heating source 12.

Due to the high temperature of the first heating source 12, the self-sealing member 14 melts in a short period of tens of seconds to one minute and mixes with the melt that is originally contained in the crucible 11. The mixed melt then flows out of the crucible 11 through the bottom pouring opening 13 and into an inner distributor 17. The inner distributor 17 is maintained at a suitable high temperature, which is determined based upon the casting mold, by the heating furnace 15. The melt is then separated into two or more streams, as it is two in the illustrated embodiment. The melt streams flow through flow pipes 18 (only two pipes being shown in the drawings) to a turnport 19 located therebelow. At this moment, the driving rod 16 is lowered down to a standby or home position and stopped there for about 10 seconds to have the melt become levelled at which time a pouring rod 30 (see FIG. 3A) located below the turnport 19 is pulled away to allow the melt to flow through pouring holes 190 (FIG. 3A) formed on the bottom of the turnport 19 into, for example, sand molds, shell molds, lost wax molds or any other suitable molds 20 that are located directly under the pouring holes 190 and have been heated for a period of approximately 10–20 seconds to perform casting operation. The number of the pouring holes 190 may be one or more (depending upon the amount of casting molds needed) formed on the bottom of the turnport 19.

The process that the melt flows from the inner distributor 17 through the flow pipes 18 into the turnport 19 is completely operated inside the heating furnace (second heating source 15) which is full of high temperature air. This ensures that no humidity contained in the atmosphere is absorbed by and into the melt again and the quality of the casting product is improved. This is particularly true in a high humidity environment, such as that having island climate. Further, since the whole pouring process is operated in a closed space, bodily injury to the operator caused by explosion or spill of melt can be minimized. The risk of operators to face the contact with high temperature is also reduced; work safety will also be improved.

Figure 3A:
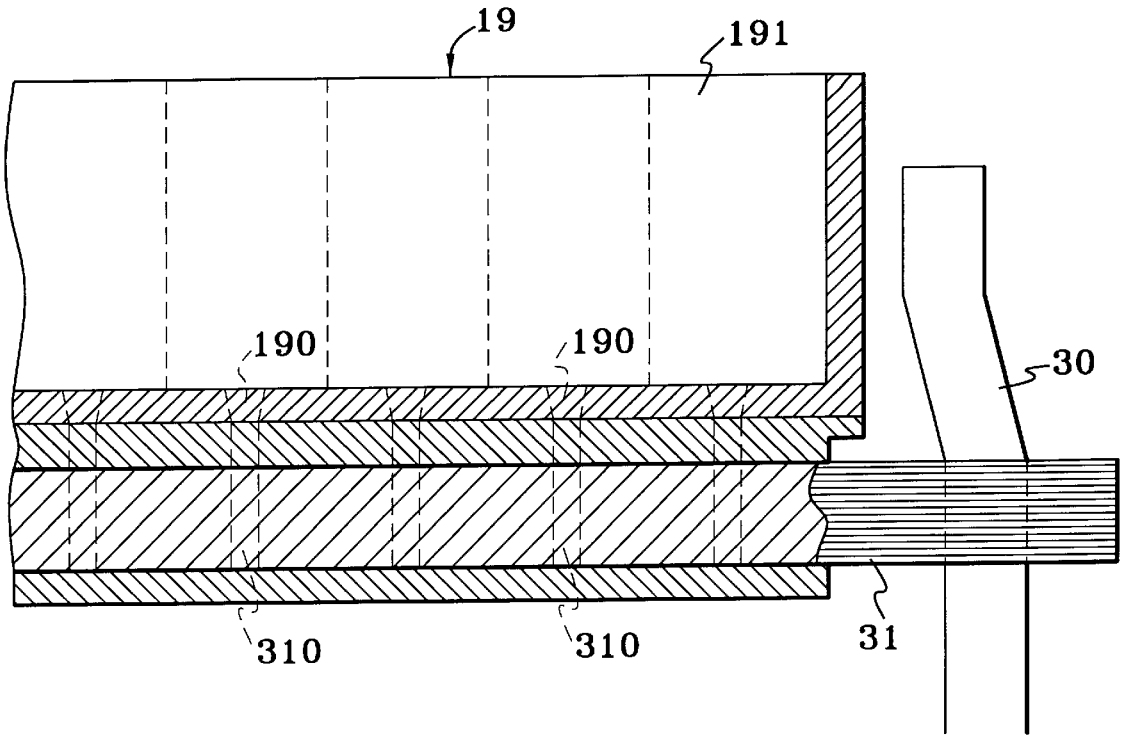
FIG. 3A is a schematic view showing the turnport control device.
Figure 3B:
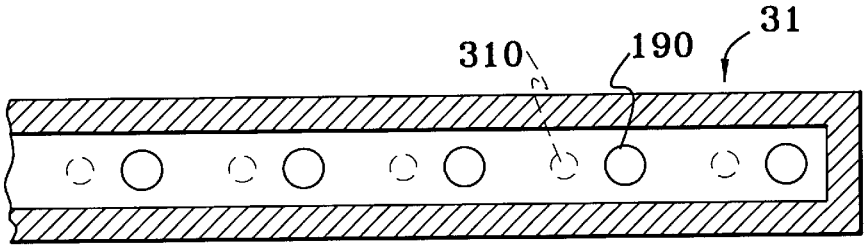
FIG. 3B is a top plan view of the link rod of FIG. 3A, wherein the through holes of the link rod are offset from the pouring holes.

With reference to FIG. 3A, the pouring rod 30 is coupled to the driving rod 16 and is to be movable in response thereto. The pouring rod 30 is in the form of a crank, extending through and coupled to a transversely extending link rod 31 which comprises a plurality of through holes 310 thereon corresponding to the pouring holes 190 of the turnport 19. As shown in FIG. 3A, the turnport 19 is spatially divided into a plurality of compartments 191 in correspondence with the pouring holes 190. Each of the pouring holes 190 corresponds to its respective compartment 191. Each of the compartments 191 can be selectively blocked by melt control means, which will be described hereinafter. When the driving rod 16 moves upward and forces the self-sealing member 14 which is received in the opening 13 formed in the bottom of the crucible 11 into the high temperature smelting zone 12 and allows the melt to flow through the inner distributor 17 and the flow pipes 18 into the turnport 19, the pouring rod 30 is moved with the movement of the driving rod 16 to force the link rod 31 to move in a direction toward the turnport 19. The through holes 310 of the link rod 31, as shown in FIG. 3B, are offset from the pouring holes 190 and thereby close the bottom of the turnport 19 so that the melt may be uniformly distributed inside the turnport 19 by way of a connecting tube 192 (see FIG. 5). When the melt is completely filled into the turnport 19, the driving rod 16 is moved downward and the pouring rod 30 moves downward correspondingly to force the link rod 31 to move in a direction away from the turnport 19. The through holes 310 of the link rod 31 now respectively match the pouring holes 190 of the turnport 19 to form passages to allow the melt contained in the turnport 19 to flow into the molds 20. The turnport control device constituted by the pouring rod 30 and the link rod 31 overcomes the non-uniform problem of the prior melt dumping technique by means of manually pouring the melt into a number of molds.

Figure 4A:
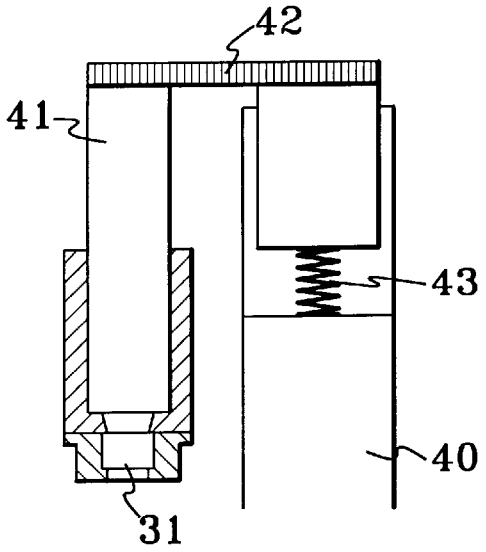
FIG. 4A is a schematic view showing the melt regulation device in accordance with the present invention.
Figure 4B:
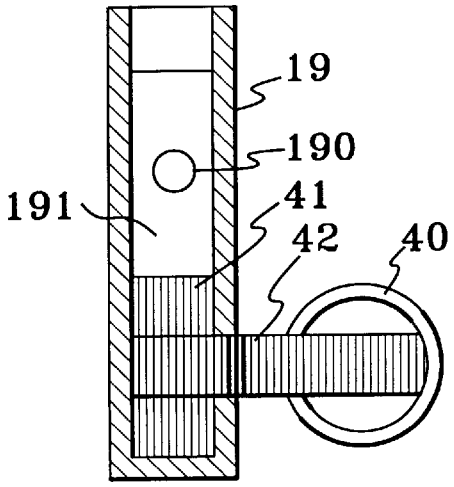
FIG. 4B is a top plan view of FIG. 4A.

The present invention further provides a melt control device which allows an adjustment of the amount of melt to be poured into molds when the size of the castings is varied or when the size and number of the molds are changed due to, for example, change of the size of the parts utilized in the pouring process or change of working schedule. However, the total amount of melt to be poured or cast should depend upon the maximum capacity of the crucible. Crucibles of different capacity cannot be exchangeable in utilization. As shown in FIG. 4A, the melt control device comprises a transmission rod 40 and a plug rod 41. The transmission rod 40 has a first end connected to a control panel 50 located outside the closed heating furnace (second heating source 15) (see FIG. 5) and a second end connected to the plug rod 41 in a mutually parallel manner by means of a connecting plate 42. Each of the compartments 191 has a respective melt control device associated therewith and the size of the plug rod 41 is receivable within the corresponding compartment. FIG. 4A is a schematic side elevational view, showing the plug rod 41 received within the respective compartment. FIG. 4B is a top view of FIG. 4A. In FIG. 4B, one of the compartments 191 is not blocked, while an adjacent one of the compartments 191 is blocked by the plug rod 41. This way, it is possible to selectively block some of the compartments to regulate the amount of the melt. The control panel 50 is a hand or leg operating device, allowing the operator located outside the heating furnace (second heating source 15) to elevate (to un-block the compartment) or lower (to block the compartment) the plug rod 41.

Again referring to FIG. 1, the molds 20 are positioned and held within mold holders 21 which are in turn supported on a mold platform 22 integrally made of ceramic material. The mold holders 21 are made individually and separate from each other for ready replacement. The functions of the mold holders 21 are (a) to hold the molds 20 in position and to make them substantially perpendicular to the pouring holes 190, and (b) to contain the melt in case of broken mold so as to prevent the leaking melt from influencing other components of the system. After the casting process is completed, only the melt of the broken mold contained within the mold holder 21 is required to be cleaned. The broken mold can be determined to be fixed or replaced basing on the extent that the mold is damaged. It should be noted that the mold holders 21 and the platform 22 can be variable in accordance with different molds 20.

Figure 5:
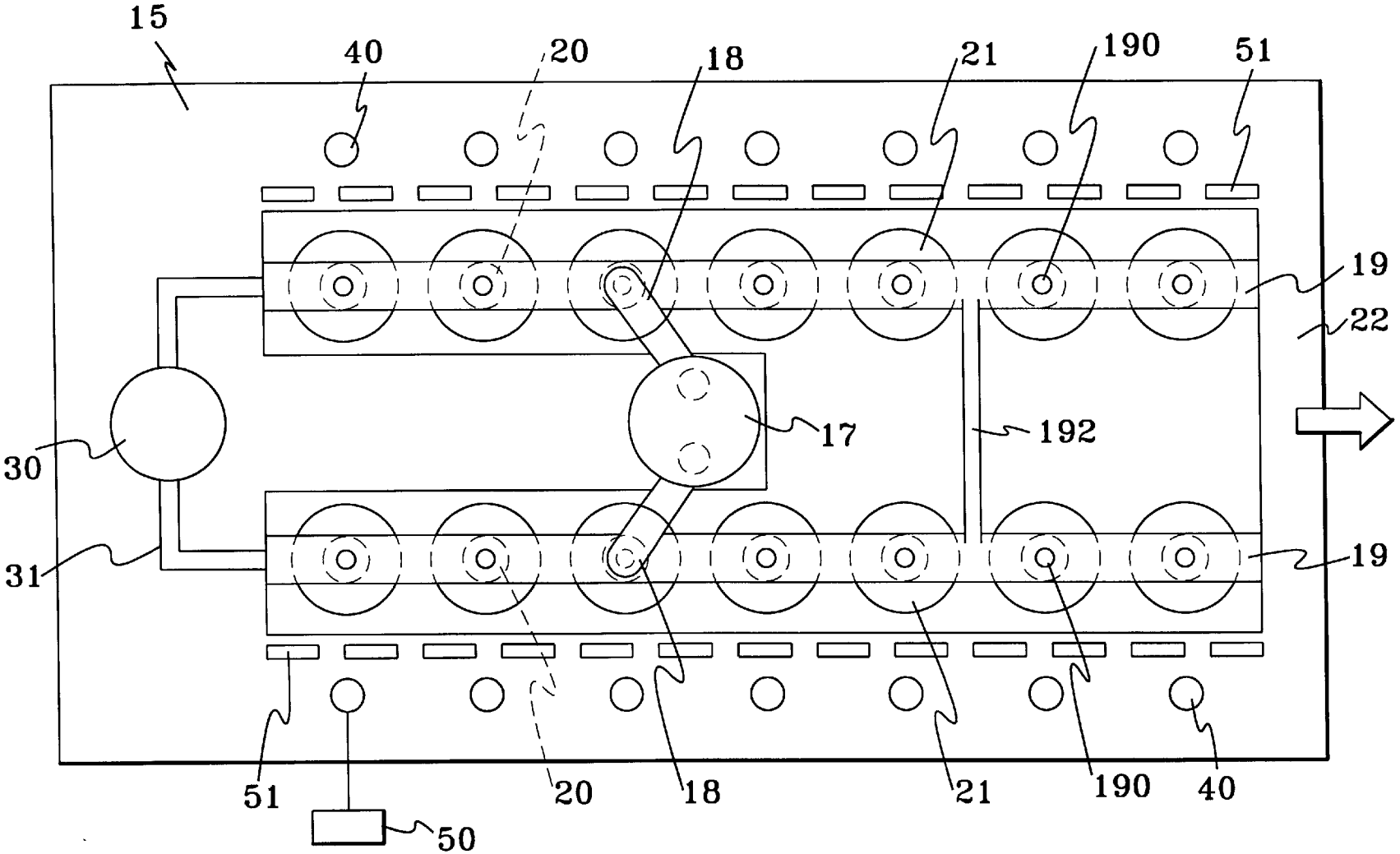
FIG. 5 is a top plan view of the self-sealing bottom pouring system viewed from the inner distributor.

Referring to FIG. 5 which is a top plan view of the portion of the system 10 shown in FIG. 1 and is viewed from the inner distributor 17, in the illustrated embodiment, the mold platform 22 has a U shape with the opening thereof corresponding to the driving rod 16. When the operator heats the molds 20 inside the furnace (the second heating source 15) (which takes approximately 30–35 minutes depending upon the time that it takes to melt the raw material inside the crucible 11, remove the slag and degas), the operator can secure the molds 20 (to have them be ready to be placed into the furnace) and move out the platform 22 by means of rollers 51 in the direction of the arrow for removing the finished molds 20. A skilled operator will be fully capable of undertaking the loading/unloading of the molds solely. Also, during the period of 30–35 minutes, only a raw material feeding operator is required to take the job of feeding raw material into the system and removing the slag. It may be suggested establishing standard operation procedures for different materials so that the dependency upon the skill or experience of individual operator may be minimized.

In conclusion, the self-sealing bottom pouring system is a simple, semi-automated system. Due to the variation of the melting and casting operation, a variety of alloys utilized, and the changes of the raw material in shape and weights, full automatization having serious problems which is hard to overcome is in general not utilized. Thus, the semi-automatization is instead adapted to reduce the operation cost. The constructive configuration of the semi-automated system according to the present invention is simple and easy to maintain. The semi-automatized operation procedure in accordance with the present invention includes the steps as follows:

(A) the lower portion operator places the molds 20 into the furnace (second heating source 15). When the furnace door is closed, an indicator on the upper portion is lit, showing that this action is completed.

(B) It follows that the operation panel on the upper portion shows:

1. the molds 20 are positioned and heated;
2. plug in the self-sealing member 14;
3. feed raw material (first time);
4. feed raw material (second time);
5. feed raw material (third time);
6. add flux (such as river sand, lime and fluorite);
7. remove slag;
8. degas;
9. refine;
10. move the driving rod 16 upward. (According to the above steps, the operator should push the button after each step is completed. The indicator then changes in color to indicate that a step is completed and the indicator of the next step is lit to inform the operator to proceed with the next step.)
11. when the self-sealing member 14 is molten, the melt flows into the inner distributor 17 and a thermometer on the inner distributor 17 shows that the temperature reaches the desired pouring temperature, the driving rod 16 moves back to the home position (i.e. the initial position prior to its moving upward and at this moment, the link rod 31 of the turnport 19 is still in the closed position).
12. at this moment, the melt has flown through the flow pipes 18 into the turnports 19 and reaches a substantially level condition by flowing through the connecting tubes 192 between the two turnports 19 (FIG. 5); this step takes approximately 10 seconds.
13. At the time the temperature shown on the thermometer disposed on the turnport 19 increases to the desired pouring temperature; the driving rod moves downward to the pouring position which causes the link rod 31 located under the turnport 19 to be fully open, allowing the melt to pour into the molds 20 (which have been heated uniformly) through the (one or numerous) pouring holes 190 located directly under the turnport 19; in total, it takes approximately 30 seconds to 2 minutes to melt the self-sealing member 14, flow the melt through the inner distributor 17 and the flow pipes 18 to the turnport 19, and then pour it into the molds 20.

(C) When the melt is poured into the molds 20, the temperature of the molds 20 increases to that which is slightly lower than the predetermined pouring temperature. At this moment, the indicator located on the outer surface of the furnace is lit up. The operator then opens the furnace door and moves the mold platform 22 out, and then places the platform 22 on a revolving support base (not shown). After activating the revolving support base, the platform 22 is moved to a cooling zone to proceed with a solidification process. The cooling zone can be selectively provided with covering material to slow down the solidification or provided under pressurized air stream to speed up the solidification. The operator may then move another platform on which new molds 20 are placed into the furnace and then close the furnace door to proceed with the pouring operation for the next batch.

The system according to the present invention provides standardization of the pouring operation and only the operation time and temperature need to be changed in accordance with a standard operation regulation which is formulated in accordance with past working record or experience when the alloys are different or the size and shape of the castings are changed. Thus the same batch of castings may be manufactured in a continuous manner under a same condition, thereby saving the time and energy that the heating furnace takes to heat up to the desired temperature.

The above described system 10 of the present invention is to be operated in the atmosphere, which is also referred to as "self-sealing atmospheric Type A furnace" hereinafter. In order to further improve the quality and mechanical property of the castings and to avoid miss run, it may need to adapt a self-sealing bottom pouring vacuum Type V furnace, which is Type A operated under a vacuum environment. The Type V furnace possesses all the advantages of the atmosphere Type A furnace and further comprises a vacuum shield which completely shields the system after the removal of the slag from the crucible to allow the establishing of a vacuum environment to perform the effect of a vacuum degassing operation. The vacuum environment also helps the gaseous portion suspended on the surface of the melt escape from the melt due to the sudden decreasing of pressure. Further, since the pouring operation is conducted in the vacuum, the amount of gaseous portion consolidated in the melt will definitely decrease gradually.

Further, no gas blocking would happen in the mold cavity of the sand mold, shell mold, lost wax mold and metal mold under a vacuum condition so that the melt may readily flow to tips or edges of the mold cavity, thereby eliminating miss run and being suitable for casting thin and sharp products, such as a rotary blade.

The degree of vacuum may be changed in accordance with the requirement of different users. The external devices, such as a heat exchanger and cold traps may be incorporated to comply with the requirements of different users. A preferred vacuum degree is 0.001 Torr which is sufficient for most of the casting operation. The Type V furnace of the present invention can be operated in both negative (vacuum) and positive pressure conditions. The mold heating furnace has a check valve controlled inert gas inlet to provide particular alloys with protective gases, provide chamber flash that is needed in a high degree vacuum environment, or provide pressurization prior to the solidification of the metal for increasing the density of the castings.

The vacuum Type V furnace does not only improve casting quality, but also upgrade the casting industry and increase the profit, as well as improve the safety of working environment. The operator no longer needs to continuously contact the environment with high temperature. If a filtering device is provided on the degassing outlet, the air pollution caused thereby can be reduced.

The self-sealing pouring furnace, either Type A or Type V, proceeds with the pouring operation completely inside the closed heating furnace (second heating source 15) so that not only the quality is improved and the operation procedure can be standardized, but the heat lost caused by conveying the heated molds 20 via atmosphere may also be minimized. Thus, the temperature of the heating furnace 15 to be sustained can be reduced by approximately 200°–300° C. Further, since the melt is kept inside the heating furnace (second heating source 15) during the pouring operation and after being poured into the molds, the heat dissipated from the molds during the solidification of the castings is constrained inside the heat furnace (second heating source 15) so that after several pouring cycles, the heating furnace (second heating source 15) needs only a small amount of heat supplemented from an external source (such as electricity, oil or gas) to maintain its temperature. It may even need a cooling air stream to reduce the inner temperature of the heating furnace (second heating source 15) after several days of operation in order to maintain the correct casting temperature. Thus, the present invention also contributes to reduction in energy consumption and improvement in working environment.

Although the present invention has been described by the preferred embodiments as mentioned above, it is apparent to those skilled in the art that various modifications and changes may be done on the preferred embodiments without departing from the scope and spirit of the present invention. The scope of the present invention is thus defined by the appended claims.

We claim:

1. A pouring system, comprising:

a crucible for receiving raw material, the crucible having an opening formed on a bottom thereof;

a first heating source for heating and melting the raw material into a melt;

a self-sealing member, made of a material which is the same as the raw material, for blocking the opening;

a driving rod for supporting the self-sealing member thereon which is upward movable to force the self-sealing member into the first heating source completely to have the self-sealing member molten and thus un-blocking the opening when the raw material is molten;

at least one turnport for receiving the melt from the crucible when the opening is un-blocked, each of the turnports comprising a plurality of pouring holes separated from each other; and a turnport control device which closes the pouring holes in response to an upward movement of the driving rod to retain the melt within the turnport and opens the pouring holes in response to the downward movement of the driving rod to pour the melt which has been completely filled in the turnport.

2. The system as claimed in claim 1, wherein the crucible comprises a truncated raised portion centrally formed on the bottom thereof and the opening being formed through the raised portion.

3. The system as claimed in claim 1, further comprising a second heating source, a major portion of the self-sealing member being located within the second heating source.

4. The system as claimed in claim 3, wherein the second heating source is a closed heating furnace, in which the closed heating furnace has a temperature lower than the first heating source to prevent the self-sealing member from being completely molten.

5. The system as claimed in claim 1, further comprising a second heating source which is a closed heating furnace, a major portion of the self-sealing member being located within the closed heating furnace which has a temperature lower than the first heating source and is operated at or lower than 0° C.

6. The system as claimed in claim 1, further comprising an inner distributor disposed between the self-sealing member and the driving rod, the inner distributor receiving the melt which flows through the opening and having a plurality of flow pipes connected thereto, the flow pipes conducting the melts from the inner distributor to the turnport.

7. The system as claimed in claim 1, including a plurality of turnports wherein the turnports comprise at least one connecting tube connected therebetween.

8. The system as claimed in claim 1, wherein the turnport control device comprising:

a pouring rod coupled to the driving rod, the pouring rod being movable in response to the movement of the driving rod, the pouring rod being in the form of a crank; and a link rod, transversely connected to the pouring rod and transversely movable in response to the movement of the pouring rod, the link rod being disposed under the turnport and having through holes corresponding to the pouring holes so that when the pouring rod is moved upward, the through holes are offset from the pouring holes to close the pouring holes and when the pouring rod is moved downward, the through holes match the pouring holes correspondingly to allow the melt to flow out of the turnport.

9. The system as claimed in claim 1, further comprising a melt control device corresponding to and associated with each of the pouring holes, each of the melt control devices being selectively receivable within a compartment defined by the respective pouring hole, the melt control device comprising:

a plug rod, selectively receivable within the respective compartment; and a transmission rod, having a first end connected to the plug rod in a mutually parallel manner by means of a connecting plate and a second end connected to a control panel located outside the second heating source, the control panel being selectively operable by an operator to move the plug rod into/out of the compartment.

10. The system as claimed in claim 1, wherein the system is arranged within a vacuum environment.

11. The system as claimed in claim 1, further comprising a platform on which a plurality of mold holders are fixed, each of the mold holders receiving and holding a mold therein into which the melt flowing out of the respective pouring hole is poured.

* * * * *